US006314584B1

(12) United States Patent
Errera

(10) Patent No.: US 6,314,584 B1
(45) Date of Patent: Nov. 13, 2001

(54) MASSAGING SOCKS, KNEE-SOCKS AND TIGHTS

(75) Inventor: Jean-Patrick Errera, Le Vésinet (FR)

(73) Assignee: VDC Innovation S.a.r.l., Vesinet (FR)

( * ) Notice: Subject to any disclaimer, the term of this patent is extended or adjusted under 35 U.S.C. 154(b) by 0 days.

(21) Appl. No.: 09/508,518

(22) PCT Filed: Oct. 27, 1998

(86) PCT No.: PCT/FR98/02293

§ 371 Date: Mar. 27, 2000

§ 102(e) Date: Mar. 27, 2000

(87) PCT Pub. No.: WO99/22690

PCT Pub. Date: May 14, 1999

(30) Foreign Application Priority Data

Nov. 3, 1997 (FR) ..... 97/13767
Apr. 2, 1998 (FR) ..... 98/04123

(51) Int. Cl.[7] ..... A41B 11/00
(52) U.S. Cl. ..... 2/239
(58) Field of Search ..... 2/239, 240, 241, 2/242, 161.3, 161.8; 36/43, 44, 144

(56) References Cited

U.S. PATENT DOCUMENTS

| | | | | |
|---|---|---|---|---|
| 74,912 | * | 2/1868 | Hadley | 36/44 |
| 4,651,354 | * | 3/1987 | Petrey | 2/239 |
| 4,674,203 | * | 6/1987 | Goller | 36/44 |
| 4,760,655 | * | 8/1988 | Mauch | 36/44 |
| 4,823,799 | | 4/1989 | Robbins . | |
| 4,841,647 | * | 6/1989 | Turucz | 36/44 |
| 4,843,738 | * | 7/1989 | Masuda | 36/44 |
| 5,500,956 | * | 3/1996 | Schulkin et al. | 2/161.1 |
| 5,551,173 | * | 9/1996 | Chambers | 36/44 |
| 5,553,398 | * | 9/1996 | Schnewlin-Maier | 36/43 |
| 5,625,900 | * | 5/1997 | Hayes | 2/161.8 |
| 5,664,342 | * | 9/1997 | Buchsenschuss | 36/43 |
| 5,685,094 | * | 11/1997 | Lin | 36/141 |
| 5,694,705 | * | 12/1997 | Coves | 36/44 |
| 5,735,804 | * | 4/1998 | Chan | 601/136 |
| 5,791,163 | * | 8/1998 | Throneburg | 66/178 |
| 5,894,687 | * | 4/1999 | Lin | 36/141 |
| 5,896,680 | * | 4/1999 | Kim et al. | 36/28 |
| 6,138,281 | * | 10/2000 | Chiaruttini | 2/239 |

FOREIGN PATENT DOCUMENTS

| | | | | |
|---|---|---|---|---|
| 4037821 | | 6/1992 | (DE) . | |
| 966891-A2 | * | 12/1999 | (EP) | A41B/11/00 |
| 8-144103 | | 6/1996 | (JP) . | |

OTHER PUBLICATIONS

"Apprendre ``masser les pieds" (La sant´´pas les pieds) ["Learning Foot Massage" (Health by the feet)]published by Vivez Soleil de Genève.

* cited by examiner

*Primary Examiner*—John J. Calvert
*Assistant Examiner*—Alissa L. Hoey
(74) *Attorney, Agent, or Firm*—Greenblum & Bernstein, P.L.C.

(57) ABSTRACT

A device for ensuring self-massaging of the foot when walking. The device includes a foot engaging surface comprising a base having raised prints incorporated thereon. The foot engaging surface is one of a standard type, a medical type, and a paramedical type. The foot engaging surface is one of a stocking, a tight, a sock and a foot pad.

32 Claims, 1 Drawing Sheet

MASSAGING SOCKS, KNEE-SOCKS AND TIGHTS

BACKGROUND OF THE INVENTION

1. Field of the Invention

The present invention relates to a device for improving the psychological anti-stress state of a person (thereby reducing the consumption of sedatives, antidepressants).

2. Description of Background and Relevant Information

The massaging socks, stockings, knee-highs, tights and foot pads call for two techniques: a basic technique referred to as the relaxing intuitive massage, and a more sophisticated technique referred to as the plantar reflexology, born from the Chinese medical tradition which describes the foot reflex areas (the equivalent of the body's acupuncture points).

The empirical massage of the foot provides a certain well-being known to mothers and their toddlers:.the tickling of the plantar zone causes a euphoric effect, or even an improvement of the mental state, with an influence on the physical health through laughter.

Based on these preliminary findings, Dr. Christian Tel SCHELLER has developed a theory on foot massage in his book entitled "Apprendre a masser les pieds" (La santépar les pieds) ["Leaming foot massage" (Health by the feet)] published by Vivez Soleil de Genéve.

The author has developed his study of the plantar massage leading to the revelation of the reflex areas, which are described in detail by Mireille MEUNIER in her book on plantar reflexology. The particularly concentrated reflex areas are described by way of drawings, the stimulation thereof through massage has relaxing, even soothing effects on numerous organs that are sore due to disorders of diverse origins: hormonal disorders, functional disorders, whether digestive, respiratory, circulatory, or even orthopedic, such as back pain which is so frequent nowadays.

DETAILED DESCRIPTION OF THE INVENTION

Figure 1:
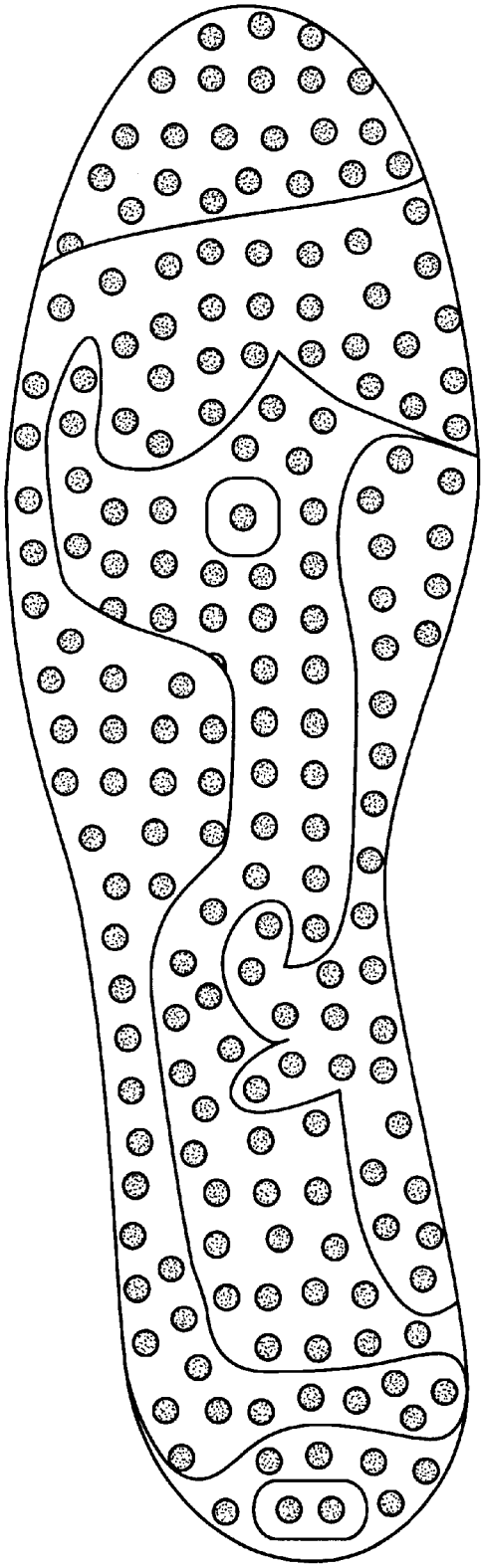
FIG. 1 shows by way of example the implanted raised bumps on a left foot.

The present invention is directed to associating socks, stockings, knee-highs, tights and foot pads, whether standard, medical (retention stockings and tights) or paramedical (preventive or maintenance stockings and tights, from 22 decitex for the weakest to 156 decitex for the strongest), with a plantar arch having a set of rounded protuberances with variable size and density depending on the zones of plantar reflexology to stimulate.

By way of a non-limiting example, the average density over 5 $cm^2$ is on the order of 7–15 bumps. The composite material forming the bumps is composed of various polymers and adhesives loaded, as necessary, with technical ceramics or metallic oxides, in order to obtain properties of strength, flexibility and variable hardness.

The raised rounded implants with variable density also make it possible to exert pressures that stimulate blood circulation in the plantar venous sole, a stimulation and acceleration of the venous and arterial flows with a better backflow of blood to the upper parts of the body, which contributes to alleviate the heaviness in the legs of persons who have remained standing for an extended period of time or, in general, of sedentary persons.

Self-massaging is therefore activated when walking during the day. Wearing footwear can also facilitate a manual massage insofar as the bumps allow an enhanced stimulation of the reflex areas. The therapeutic anti-stress effect can be improved by wearing these socks after a relaxing footbath, in direct contact with the floor in the person's residence.

According to the invention, a foot garment for ensuring self-massaging of the foot when walking, comprises a technical face, and a technical back. The technical back includes a foot engaging surface comprising a base and raised prints incorporated on the foot engaging surface. The foot engaging surface is one of a standard type, a medical type, and a paramedical type. Further, the foot engaging surface comprises one of a stocking, a tight, a sock and a foot pad. The raised prints are arranged at a level of a plantar venous sole. The raised prints are arranged in reflex areas according to Chinese medical tradition. Further, the raised prints are made of a composite material. Additionally, the raised prints are rounded.

According to another aspect of the invention, a foot garment for ensuring selfmassaging of the foot when walking, comprises a technical face, a technical back, the technical back including a foot engaging surface comprising a plurality of rounded protuberances having variable size and density. The foot engaging surface is one of a standard type, a medical type, and a paramedical type. Additionally, the foot engaging surface comprises one of a stocking, a tight, a sock and a foot pad. The protuberances are disposed in an area of a plantar arch of the foot of the wearer of the foot garment. The protuberances are arranged with an average density of 7–15 bumps over 5 $cm^2$. Furthermore, the protuberances comprise bumps made of a composite material. The composite material comprises one of a polymer and an adhesive. The bumps comprise one of a technical ceramic and a metallic oxide having properties of strength, flexibility and variable hardness. Further, the bumps have a variable density and are adapted to exert pressures that stimulate blood circulation in a plantar venous sole.

A device according to yet another aspect of the invention, comprises one of a stocking, a tight, a sock and a foot pad for ensuring self-massaging of the foot when walking. The device comprises a foot engaging surface, the foot engaging surface including a base, and raised prints incorporated on the foot engaging surface. The foot engaging surface is one of a standard type, a medical type, and a paramedical type. The raised prints are arranged at a level of a plantar venous sole. Further, the raised prints are arranged in reflex areas according to Chinese medical tradition. The raised prints are made of a composite material. Additionally, the raised prints may be rounded.

Further yet, a device according to the invention comprises one of a stocking, a tight, a sock and a foot pad for ensuring self-massaging of the foot when walking. The device comprises a foot engaging surface comprising a plurality of rounded protuberances having variable size and density. The foot engaging surface is one of a standard type, a medical type, and a paramedical type. The protuberances are disposed in an area of the plantar arch. The protuberances are arranged with an average density of 7–15 bumps over 5 $cm^2$. Further, the protuberances comprise bumps made of a composite material. The composite material comprises one of a polymer and an adhesive. The bumps comprise one of a technical ceramic and a metallic oxide having properties of strength, flexibility and variable hardness. The bumps have a variable density and are adapted to exert pressures that stimulate blood circulation in a plantar venous sole.

What is claimed is:

1. A foot garment for ensuring self-massaging of the foot when walking, comprising:

a technical face;

a technical back;

said technical back including a foot engaging surface comprising a base; and raised prints incorporated on the foot engaging surface.

2. The foot garment according to claim 1, wherein the foot engaging surface is one of a standard type, a medical type, and a paramedical type.

3. The foot garment according to claim 1, wherein the foot engaging surface comprises one of a stocking, a tight, a sock and a foot pad.

4. The foot garment according to claim 3, wherein the raised prints are made of a composite material.

5. The foot garment according to claim 1, wherein the raised prints are arranged at a level of a plantar venous sole.

6. The foot garment according to claim 5, wherein the raised prints are arranged in reflex areas according to Chinese medical tradition.

7. The foot garment according to claim 1, wherein the raised prints are rounded.

8. A foot garment for ensuring self-massaging of the foot when walking, comprising:

a technical face;

a technical back;

said technical back including a foot engaging surface comprising a plurality of rounded protuberances having variable size and density.

9. The foot garment according to claim 8, wherein the foot engaging surface is one of a standard type, a medical type, and a paramedical type.

10. The foot garment according to claim 8, wherein the foot engaging surface comprises one of a stocking, a tight, a sock and a foot pad.

11. The foot garment according to claim 8, wherein the protuberances are disposed in an area of a plantar arch.

12. The foot garment according to claim 8, wherein the protuberances are arranged with an average density of 7–15 bumps over 5 $cm^2$.

13. The foot garment according to claim 12, wherein the protuberances comprise bumps made of a composite material.

14. The foot garment according to claim 13, wherein the composite material comprises one of a polymer and an adhesive.

15. The foot garment according to claim 14, wherein the bumps comprise one of a technical ceramic and a metallic oxide having properties of strength, flexibility and variable hardness.

16. The foot garment according to claim 14, wherein the bumps have a variable density and are adapted to exert pressures that stimulate blood circulation in a plantar venous sole.

17. A device comprising one of a stocking, a tight, a sock and a foot pad for ensuring self-massaging of the foot when walking, comprising:

a foot engaging surface;

said foot engaging surface including a base; and raised prints incorporated on the foot engaging surface.

18. The device according to claim 17, wherein the foot engaging surface is one of a standard type, a medical type, and a paramedical type.

19. The device according to claim 18, wherein the raised prints are arranged at a level of a plantar venous sole.

20. The device according to claim 19, wherein the raised prints are arranged in reflex areas according to Chinese medical tradition.

21. The device according to claim 19, wherein the raised prints are made of a composite material.

22. The device according to claim 19, wherein the raised prints are rounded.

23. A device comprising one of a stocking, a tight, a sock and a foot pad for ensuring self-massaging of the foot when walking, said device comprising:

a foot engaging surface comprising a plurality of rounded protuberances having variable size and density.

24. The device according to claim 23, wherein the foot engaging surface is one of a standard type, a medical type, and a paramedical type.

25. The device according to claim 23, wherein the protuberances are disposed in an area of the plantar arch.

26. The device according to claim 23, wherein the protuberances are arranged with an average density of 7–15 bumps over 5 $cm^2$.

27. The device according to claim 26, wherein the protuberances comprise bumps made of a composite material.

28. The device according to claim 27, wherein the composite material comprises one of a polymer and an adhesive.

29. The device according to claim 28, wherein the bumps comprise one of a technical ceramic and a metallic oxide having properties of strength, flexibility and variable hardness.

30. The device according to claim 29, wherein the bumps have a variable density and are adapted to exert pressures that stimulate blood circulation in a plantar venous sole.

31. A device comprising one of a stocking, a tight, a sock and a foot pad for ensuring self-massaging of the foot when walking, comprising:

a foot engaging surface comprising one of a standard type, a medical type, and a paramedical type;

said foot engaging surface including a base; and raised prints made of a composite material and being rounded, incorporated on the foot engaging surface, arranged at a level of a plantar venous sole and arranged in reflex areas according to Chinese medical tradition.

32. A device comprising one of a stocking, a tight, a sock and a foot pad for ensuring self-massaging of the foot when walking, said device comprising:

a foot engaging surface of one of a standard type, a medical type, and a paramedical type, comprising a plurality of rounded bumps made of a composite material arranged with an average density of 7–15 bumps over 5 $cm^2$, disposed in an area of the plantar arch and having variable size and density.

* * * * *